United States Patent [19]

Carr et al.

[11] 4,386,640

[45] * Jun. 7, 1983

[54] ICE BODY DISPENSER

[75] Inventors: Keith E. Carr, Stevensville; John J. Symons, Benton Harbor, both of Mich.

[73] Assignee: Whirlpool Corporation, Benton Harbor, Mich.

[ * ] Notice: The portion of the term of this patent subsequent to Oct. 7, 1997, has been disclaimed.

[21] Appl. No.: 187,320

[22] Filed: Sep. 15, 1980

Related U.S. Application Data

[63] Continuation of Ser. No. 972,806, Dec. 26, 1978, Pat. No. 4,226,269.

[51] Int. Cl.[3] ..... B65B 3/04

[52] U.S. Cl. ..... 141/361; 221/206; 222/226; 222/434

[58] Field of Search ..... 222/57, 226–248, 222/424.5–440, 444, 450, 451, 453; 141/359–362, 94, 95, 351, 392; 221/206, 207

[56] References Cited

U.S. PATENT DOCUMENTS

| | | | |
|---|---|---|---|
| 307,629 | 11/1884 | Church | 222/436 |
| 1,517,923 | 12/1924 | Sylvester | 222/436 |
| 1,669,624 | 5/1926 | Moore et al. | 222/436 |
| 3,181,739 | 5/1965 | Dye | 222/436 |
| 3,227,313 | 1/1966 | Morena | 222/57 |
| 3,351,239 | 11/1967 | Flock | 141/361 |
| 3,516,269 | 6/1970 | Bromarker | 222/440 |

FOREIGN PATENT DOCUMENTS

| | | | |
|---|---|---|---|
| 572926 | 3/1924 | France | 222/434 |

*Primary Examiner*—Houston S. Bell, Jr.
*Attorney, Agent, or Firm*—Wood, Dalton, Phillips, Mason & Rowe

[57] ABSTRACT

An ice body dispenser arranged to provide preselected different quantities of ice bodies from a storage chamber as a function of the size of a receptacle, or cup, placed in a receiving position below a delivery duct thereof. The dispenser includes one or more control elements selectively insertable into the delivery duct to correspondingly adjust the amount of ice bodies delivered by a concurrent opening of the lower closure member of the device. The device includes control switches which sense the size of the cup placed in the ice body receiving position so as to cause a selective use of the different control elements. The control elements may be fork elements having one or more tines for providing improved column interception with effectively minimal crushing and breaking of the ice bodies in the column.

22 Claims, 5 Drawing Figures

12
17
11
28
3.
42
41
40
37
29
60
48
27
51
57
61
27
49
21
52
52
62
53
50
39
38
46
43
47
44
45
35
3.
10
67
16a
67'
68
34
70
68'
16b
69
69'
70'
16c
14
13
15

12
18
17
20
20
11
25
19
36
26
28
29
24
23
22
28
29
30
30
27
10
51
51
27
21
52
52
53
53
31
35
31
19
35
32
33
32
19
67'
68'
34
69'
16
16b
70'
13
14
15

58
59
57
12
44
40
43
63
60
64
65
66
37
45
46
51
47
35
56
55
55
54
56
22
54
27
30
35
21
14

41
58
37
59
57
51
56
64
65
63
66
55
38
43
54
46
44
27
47
45
31
35

L1
L2
72
71
73
67
LARGE
60a
68
MED.
61a
69
REG.
62a
74
TIME DELAY
M
76
INTERVAL TIMER
75
21
77
67'
LARGE
60b
68'
MED.
61b
69'
REG.
62b

ICE BODY DISPENSER

CROSS-REFERENCE TO RELATED APPLICATIONS

This application is a continuation of our copending application for U.S. Letters Patent, Ser. No. 972,806, filed Dec. 26, 1978, and entitled "Ice Body Dispenser" which is now U.S. Pat. No. 4,226,269.

BACKGROUND OF THE INVENTION

1. Field of the Invention

This invention relates to ice body delivery mechanisms and in particular to mechanisms for delivering any one of a preselected different quantity of ice bodies to correspondingly different sized receptacles.

2. Description of the Prior Art

In fast food establishments and the like, soft drinks are prepared in suitable cups into which ice bodies, or cubes, are first placed with the liquid portion of the drink being introduced subsequently thereinto. It is conventional to provide different size drinks utilizing different size cups.

It is desirable that preselected quantities of ice cubes be provided in the cups corresponding to the size of the cups so as to provide uniform icing of the drinks. Where manual introduction of ice into the cups is effected, a wide variation in the amount of ice provided in each cup may result, thus causing a wide variation in the icing of the different drinks. It is therefore desirable to effect such accurately metered ice delivery automatically and rapidly.

A number of devices have been developed for use in metering particulate material from a storage chamber to a delivery position. One such metering device is shown in U.S. Pat. No. 307,629, of G. S. Church. Church shows a canister having a delivery tube opening downwardly from a bottom portion of the canister which is adapted to contain grain or other similar material. The delivery tube is provided with a plurality of slots cut halfway therethrough adapted to receive a valve plate which is selectively positionable on a vertical shaft so as to be aligned selectively with any one of the slots. The lower end of the shaft carries a closure valve. Manipulation of the shaft by means of a suitable handle concurrently removes the closure valve from the lowermost portion of the delivery tube and simultaneously introduces an upper valve into the delivery tube so as to permit delivery of only that quantity of the grain in the delivery tube previously above the level of the bottom closure plate and below the level of the adjusted inserted valve plate. Church teaches that the delivery tube be made slightly tapering internally with the larger end lowermost to facilitate the discharge of the grain.

Arthur J. Sylvester, in U.S. Pat. No. 1,517,923, shows a dispensing and measuring apparatus having a measuring chamber which is divided into a plurality of compartments by a number of gates which are pivotally swung between a retracted position externally of the measuring chamber and a measuring position extending across the interior of the measuring chamber. The different gates are spaced vertically so as to provide selectively different quantities of granular material from the measuring chamber. The device is arranged so that the top of the pile of material adjacent the slot through which the gate is inserted slopes away from the slot so as to permit a free space to be provided through which the gate passes before striking the granular material.

Edgar Hayes Moore et al, in U.S. Pat. No. 1,669,624, shows a dispensing device for dispensing odd lots of articles through an outlet spout also using a number of slide valves. The slide valves are arranged to be either completely withdrawn or advanced controlling the delivery of the articles. The device is arranged for dispensing particulate material, such as sugar, and requires separate manipulation of the different valves to deliver the preselected quantity of sugar to a bag placed in receiving position at the bottom of the chute.

James E. Dye discloses, in U.S. Pat. No. 3,181,739, an ice dispenser which dispenses a predetermined amount of ice to each of a plurality of drinking cups. The quantity of ice to be delivered to each cup is provided in a corresponding pocket by means of a paddle which clears excess ice from the top of the pocket. The bottom of each pocket is then concurrently opened to drop the thusly collected ice into the subject receiving cup.

Carmen G. Morena, in U.S. Pat. No. 3,227,313, shows an apparatus for storing and automatically dispensing flowable material, such as solid or liquid detergent. Delivery of the detergent is effected by manipulation of a plurality of control gates which are moved by means of solenoids. The lowermost gate defines a closure member. When it is desired to dispense a preselected amount of detergent such as into the washing machine tube, the user firstly causes one of the measuring gates to be moved across the delivery duct to block off the upper portion of the duct. When the level of the water in the tub reaches a preselected level, a suitable control is actuated so as to then open the lowermost closure gate to thereby dump from the lower end of the delivery duct the detergent disposed therein below the upper selected control gate which is now holding back the material in the upper portion of the duct. Upon completion of the delivery operation, the closure gate is then repositioned across the lower end of the duct and all upper measuring gates restored to the open position, thereby refilling the duct for a subsequent delivery of a measured quantity of detergent therefrom in the same manner.

U.S. Pat. No. 3,516,579, of Carol O. Bromarker, shows a portion dispenser for dispensing food portions to cattle in cattle pens. Each container for delivering food to the cattle pen is provided with a flexible balloon which forms a closed bottom of the container when inflated. The balloons of the respective containers are connected to a compressed air supply and suitable controls are provided for selectively inflating and deflating the baloons. The container space above an inflated balloon is filled with food by a suitable conveyor and the collected food is then discharged by release of the pressure on that balloon to dump the food to the cattle pen.

SUMMARY OF THE INVENTION

The present invention comprehends an improved ice body dispenser including means defining a storage chamber for storing a plurality of ice bodies, means defining a delivery duct having an upper end opening into the storage chamber for receiving ice bodies therefrom, and a lower end for dispensing ice bodies therefrom, a tined element selectively insertable laterally into the duct at a preselected position intermediate the ends to prevent delivery of ice bodies downwardly therepast, the closure means for selectively closing the lower end, and operating means for concurrently inserting the tined element into the duct and removing the closure means from the lower end to dispense from the duct those ice bodies previously delivered thereto from the storage chamber disposed above the closure element and below the preselected position.

The tined element may comprise a fork having one or more tines adapted to be freely inserted through the column of ice in the duct with minimum breakage and deformation of the ice as a result of the facilitated insertion provided by the tine arrangement.

The invention further comprehends the provision of additional tined elements spaced vertically from the first named tined element. The operating means is arranged to selectively insert any one of the tined elements into the duct to provide different amounts of ice bodies from the duct as desired.

The control of the delivery of the different amounts of ice bodies may be effected automatically as a function of the size of the receptacle, or cup, placed below the delivery, lower end of the duct.

In the illustrated embodiment, the operating means includes a plurality of switches responsive to the different sizes of the receptacles to effect insertion of corresponding different ones of the tined elements so as to provide a corresponding one of the different quantities of ice bodies provided automatically by the different tine insertions.

In the illustrated embodiment, a support is provided for the cups and the operating means includes control means for detecting the height of the receptacle to provide an indication of the size of the receptacle for controlling the tine insertion operation.

In the illustrated embodiment, a plurality of such delivery ducts is disclosed leading from the storage chamber so as to provide concurrently, or individually as desired, measured delivery of ice bodies from the storage chamber in the manner discussed above.

An agitator means is provided in the storage chamber to effect a suitable agitation of the ice bodies therein to maintain the ice bodies in individual, or separated, condition for facilitated delivery thereof through the duct delivery means. This operation of the agitator means is described more fully in the co-pending application of Keith E. Carr, "Commercial Ice Maker Ice Body Dispenser Hopper and Auger Construction" PA-5013-0-CI-USA, assigned to the same assignee as the present invention.

An opening is provided from the upper end of the duct to the storage chamber extending at an angle to the horizontal. The agitating means causes movement of the ice bodies through the duct opening into the generally vertically extending duct.

The cross-sectional area of the opening to the upper end of the duct is preferably smaller than the cross section of the duct so as to assure facilitated downward delivery of ice bodies delivered into the duct from the storage chamber.

In the illustrated embodiment, the duct has a constant cross section, but may change to a larger cross section at the bottom to facilitate downward delivery.

The ice body dispenser of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
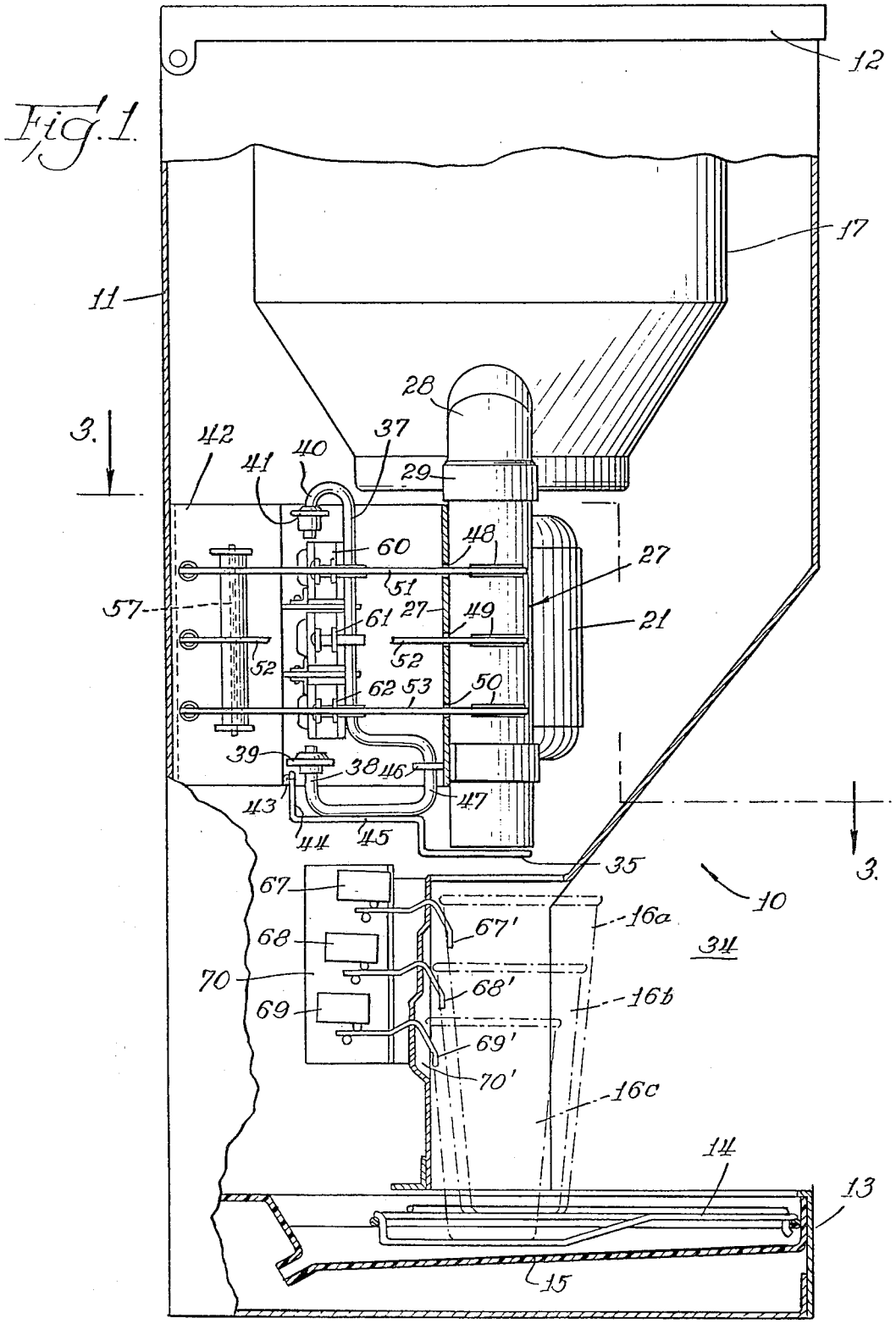
FIG. 1 is a side elevation of an ice body dispenser embodying the invention, with a portion of the sidewall broken away to facilitate illustration of the mechanism.

In the examplary embodiment of the invention as disclosed in the drawing, an ice body dispenser generally designated 10 includes an outer cabinet 11 provided with a removable top portion 12 and a base portion 13. The base portion is provided with a grid 14 below which is mounted a drain pan 15. The grid is adapted to receive any one of a plurality of different size cups 16, such as large cups **16*a*, medium size cups 16*b*, and small cups 16*c*, as shown in FIG. 1**.

Figure 2:
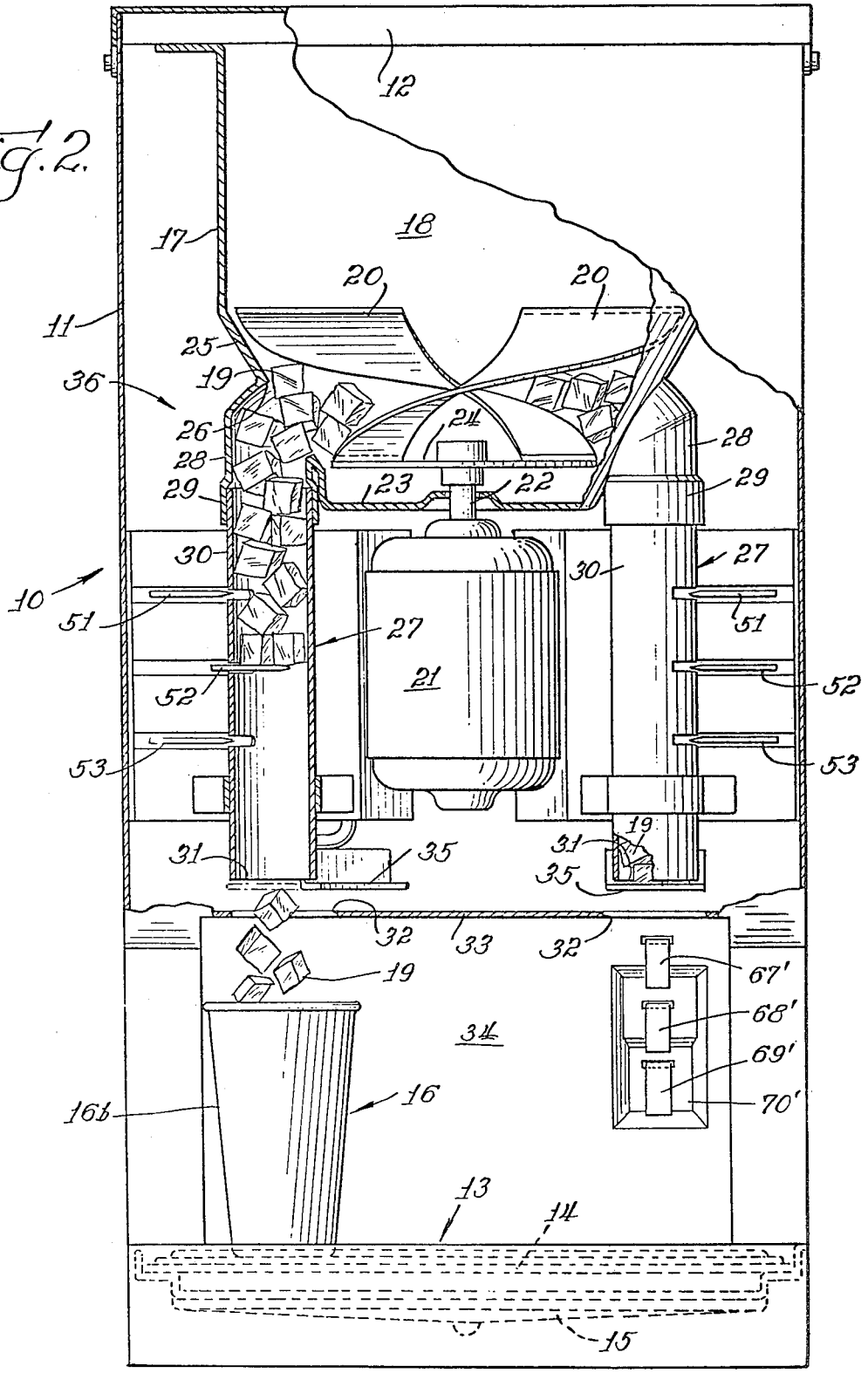
FIG. 2 is a front elevation thereof with a portion of the front wall broken away to facilitate illustration of the mechanism.

Mounted within the upper portion of cabinet 11 below the removable top 12 is a hopper 17 internally defining a storage chamber 18 for storing a plurality of ice bodies, such as ice cubes 19, to be dispensed into the cups 16, as desired and as shown in FIG. 2.

The ice bodies 19 in storage chamber 18 are agitated therein by means of an auger type blade 20 with its outer edge fit closely to the frusto-conical wall 25, driven by a suitable electric motor 21 having a shaft 22 extending upwardly through a bottom wall 23 of the hopper 17 and secured to the agitator blade 20 by means of a support plate 24.

The lower portion of the hopper 17 upstanding from bottom wall portion 23 defines a frusto-conical wall 25 provided with a plurality of openings 26 which thusly extend angularly to the horizontal and in the illustrated embodiment, at approximately a 60° angle to the horizontal.

Communicating with the storage chamber 18 through the opening 26 is a corresponding plurality of ducts 27 for delivering ice bodies downwardly from the storage chamber 18 into the cups 16 positioned on the supporting grid 14 of base 13. Each delivery duct is similar and, thus, the description of the specific construction thereof will be limited to the description of the duct at the left-hand side of FIG. 2.

As shown, the duct 27 includes a connector portion 28 extending downwardly from the upper wall portion 25 and telescopically receiving the upper end 29 of a lower duct portion 30. The lower end 31 of the duct portion 30 opens through an opening 32 in a cover wall 33 overlying the dispensing space 34 in which the cups 16 are placed on the grid 14 for receiving ice bodies in the dispensing operation.

In the illustrated embodiment, the cross-sectional area of duct 27 is substantially constant and somewhat larger than the cross-sectional area of opening 26 so as to assure a free downward movement of the ice bodies during the dispensing operation. While the cross-sectional area of duct 27 is substantially constant, the lower portion of duct 27 may be made progressively larger in area to facilitate free downward movement of the ice bodies.

Movement of the ice bodies from the storage chamber 18 through opening 26 into duct 27 is effected by the auger type blade 20 concurrently with the effecting of the agitation of the ice bodies in the storage chamber as a result of the lifting action of the ice bodies as they are pushed up the hopper wall 25 by the rotation of agitator 20. This lifting causes a void space under blade 20. The ice bodies below the void space are free of any downward pressure from above therefore they will fall through opening 26 until duct 30 is filled. The blade 20 causes the ice bodies to be pushed up the hopper wall 25 and allows them to return down the center of hopper 17 all as described in the co-pending application of Keith E. Carr referred to above. When duct 30 is filled, continued rotation of blade 20 creates the lifting action, however, the ice bodies below the void space cannot fall through opening 26 so they continue to rotate. As the openings 26 are parallel to the surface of the hopper wall 25, the ice bodies fall therethrough into the upper end of duct 27, and as a result of the somewhat larger cross-sectional area of the duct 27, are freely passed downwardly therefrom into the duct.

A closure plate 35 is provided for selectively closing the lower end 31 of the duct. When the closure plate is disposed across the lower end 31, the duct may be filled with ice bodies from the storage chamber by the action of the agitator 20 for facilitated subsequent delivery of a measured quantity of the ice bodies from the duct to the cup 16 when desired.

Figure 4:
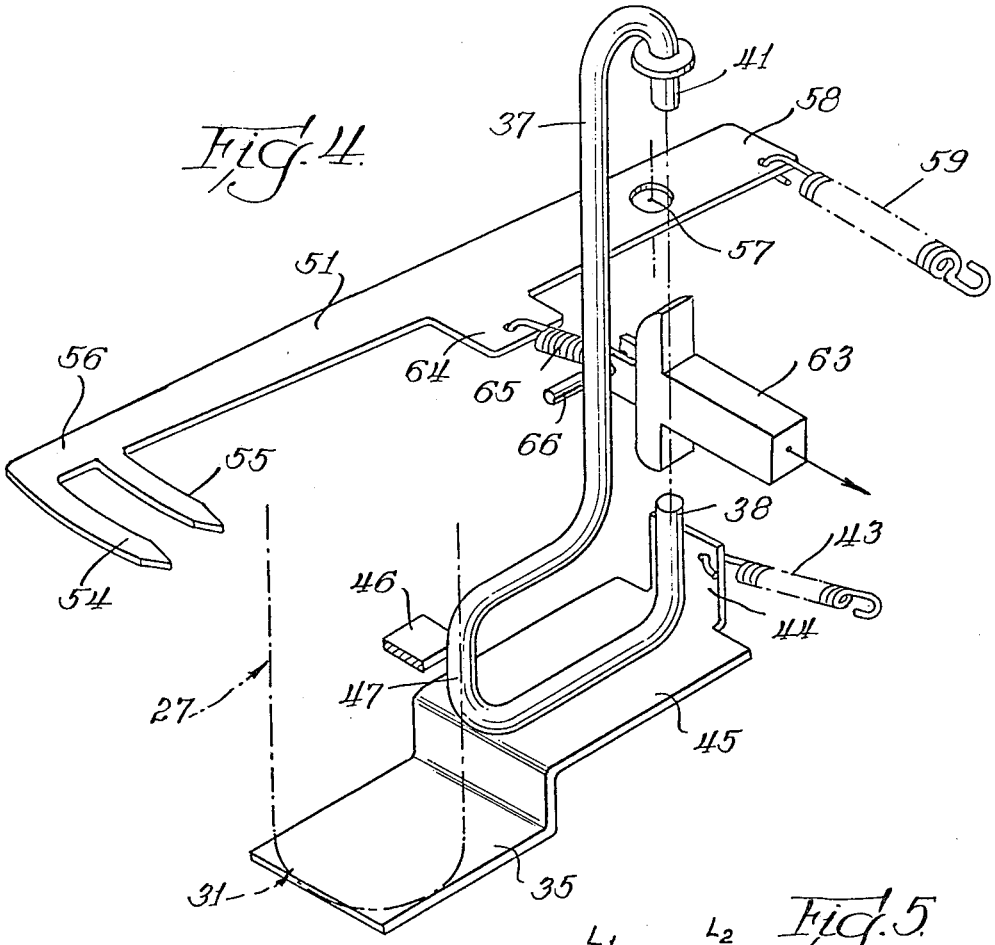
FIG. 4 is a fragmentary perspective view illustrating in greater detail the arrangement of the tine and closure plate mechanism.

As indicated briefly above, the dispenser 10 is adapted to deliver different quantities of ice bodies corresponding to the size of the different size cups placed in the delivery space 34 subjacent the duct end 31. To effect such selective quantity delivery, device 10 includes an operating means generally designated 36 (FIG. 2) having a pivot rod 37 (FIG. 4) having a first end 38 pivotally mounted to a support 39 (FIG. 1), and an opposite end 40 pivotally mounted to a support 41 carried on a frame member 42. The pivot rod 37 is urged to a centered position by a tension spring 43 connected between the frame 42 and an upstanding flange 44 on an extension 45 of the closure plate 35. Thus, as shown in FIG. 4, the closure plate 35 is normally biased to the position in which it closes the lower end 31 of the duct 27 by the spring 43. A stop 46 may be provided for limiting the pivotal movement of the pivot rod or bar 37 by engagement of a stop portion 47 of the pivot bar with the stop 46.

Figure 3:
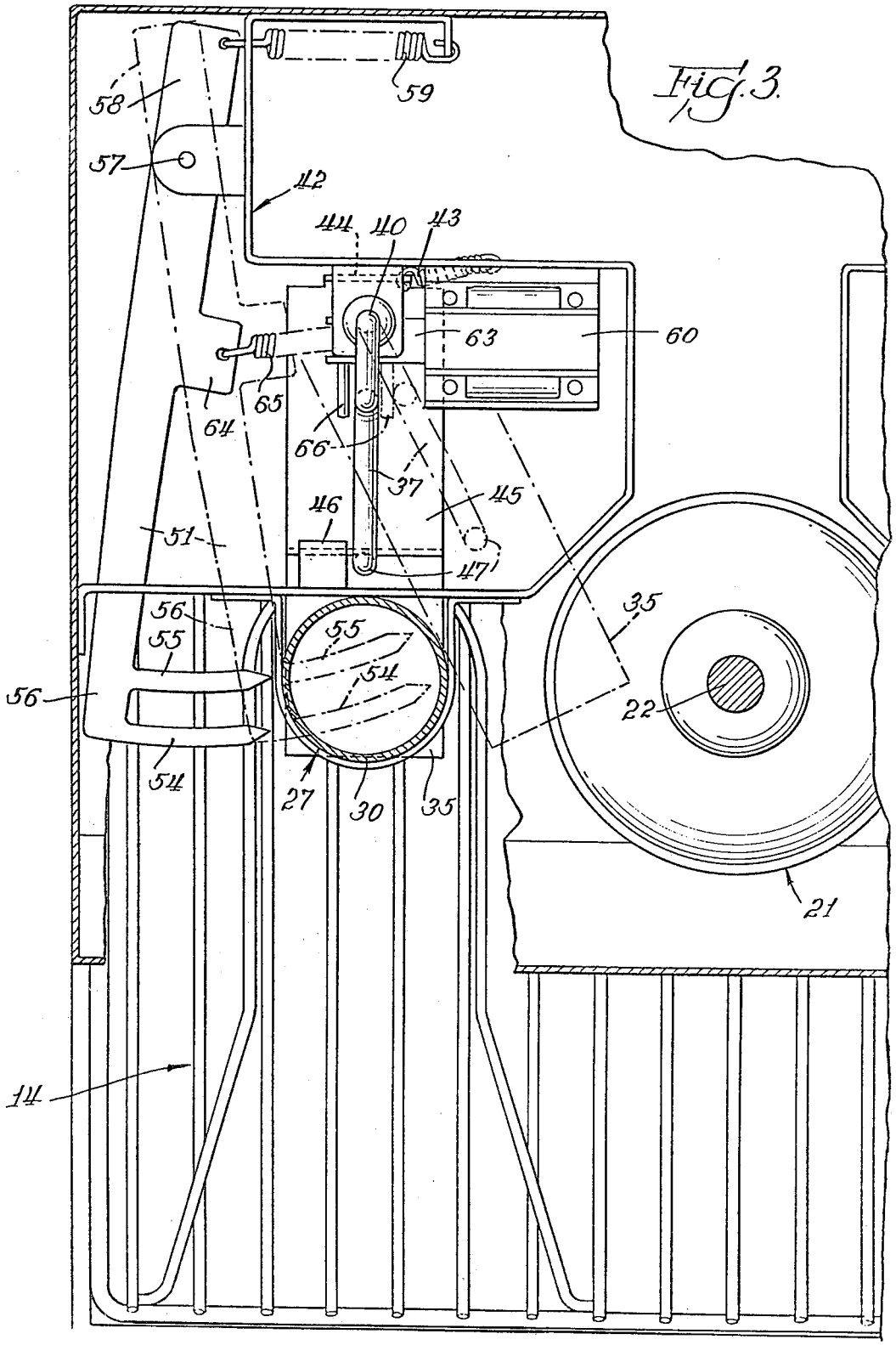
FIG. 3 is a fragmentary enlarged horizontal section taken substantially along the line 3—3 of FIG. 1.

As illustrated in FIGS. 1 and 2, duct 27 is provided with a plurality of approximately 180°-semiannular slots 48, 49 and 50 at vertically spaced positions in the duct. A corresponding plurality of control elements 51, 52, and 53 are associated with the slots 48, 49 and 50, respectively, for controlling the amount of ice bodies delivered from the duct during the dispensing operation. Each of the control elements is similar. As shown in FIG. 4, control element 51 comprises a forked element having a pair of tines 54 and 55 at its distal end 56. The tined elements 51, 52 and 53 are respectively freely pivoted to a vertical pivot rod 57 carried on frame 42 (FIG. 3) for pivotal movement about a common vertical axis at the planes of the respective slots 48, 49 and 50.

The opposite end 58 of the tined element 51 is connected by a suitable tension spring 59 to the frame 42 to bias the forked element in a clockwise direction, as seen in FIG. 4, thereby to move the tines 54 and 55 of the tined element 51 outwardly from the slot in the normal arrangement of the control elements.

Controlled pivoting of the tined elements 51, 52 and 53 is effected by operation of a corresponding plurality of electrical solenoids 60, 61 and 62, respectively. As shown in FIG. 4, a plunger solenoid 63 is connected to a midportion 64 of the tined element by a suitable buffer spring 65. Thus, when the solenoid is energized, the plunger 63 is drawn to the right, as seen in FIG. 4, to pull the tined control element in a counterclockwise direction about the pivot rod 57 against the action of spring 59 and thereby urge the tines 54 and 55 to the right, as seen in FIG. 4 and in FIG. 2. Such movement of the tines 54 and 55 causes them to become inserted through the aligned slots into the duct 27. As the tines comprise elements which may readily penetrate the column of ice bodies in the duct 27 without breaking or chipping the ice bodies, a facilitated insertion of the tines is effected with minimum damage to the ice bodies in the column.

As further shown in FIG. 4, the solenoid plunger may be further provided with an actuating pin 66 which engages the pivot member 37 to pivot member 37 about its ends 41 and 38 concurrently with the movement of the selected tined element. Thus, the closure plate 35 is concurrently moved from its underlying relationship to the duct end 31 to an open position, as shown at the left-hand side of FIG. 2, permitting the ice bodies in the duct to fall downwardly through the lower end 31 of the duct and opening 32 in the cover plate 33 into the receiving cup 16. However, as the tine elements 54 and 55 are now inserted into the column of ice bodies in the duct, only those ice bodies which were disposed in the duct subjacent the level of the selected tined element, such as tined element 51 shown in FIG. 4, will be dispensed during the dispensing operation.

Control of the respective solenoids 60, 61 and 62 is effected by suitable control switches 67, 68 and 69 mounted on a suitable switch panel 70 at the rear of the cabinet, as shown in FIGS. 1 and 2.

Figure 5:
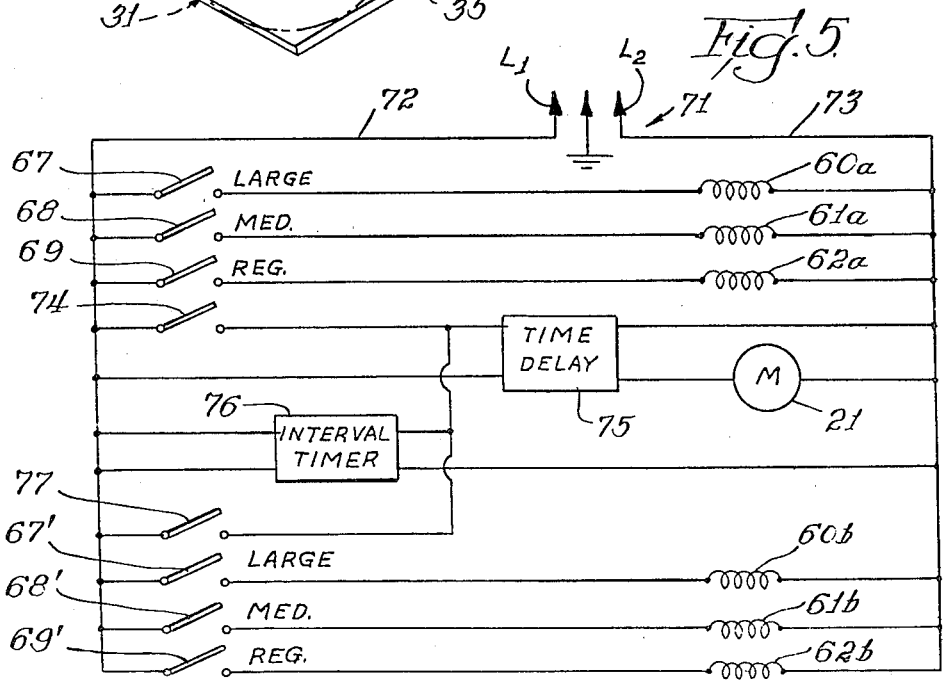
FIG. 5 is a schematic electrical wiring diagram of the dispenser.

Referring now to FIG. 5, the electrical control generally designated 71 includes a first control line 72 connected to power supply lead L1 and a second control line 73 connected to power supply lead L2. The coil **60*a* of solenoid 60 is connected in series with the switch 67 across lines 72 and 73, solenoid coil 61*a* of solenoid 61 is connected in series with switch 68 across lines 72 and 73, and coil 62*a* of solenoid 62 is connected in series with switch 69 across the lines 72 and 73. Thus, depending on the switch actuated by the given cup in the dispensing space 34, one of the solenoids 60, 61 and 62 will be energized to insert its associated tined element into the duct while concurrently removing the closure plate 35 from the bottom of the duct to deliver a preselected quantity of ice bodies from the duct which will automatically be the ice bodies which were in the duct below the level of the selected control element. As these quantities may be accurately preselected and correlated with the sizes of the different cups 16*a*, 16*b* and 16*c*, respectively, proper coordinated icing of the drinks in the different size cups is automatically effected by the simple expedient of placing any one of the different size cups in the dispensing space to engage the associated switch mechanism 67, 68 or 69**.

As further shown in FIG. 5, the control may include a left closure plate switch 74 connected in series with a time delay relay 75 across lines 72 and 73. The time delay relay, in turn, may be connected in series with the agitator motor 21 so as to effect a preselected operation of the agitator each time the left closure plate is actuated to effect delivery of ice bodies into a cup in the left side of the dispenser space 34. The time delay causes the agitation to continue for a preselected time suitable to refill the duct 27 upon completion of the previous dispensing operation, as discussed above. More specifically, upon delivery of the ice bodies as discussed above, the de-energization of the selected solenoid permits spring 59 to retract the tines 54 and 55 from the duct and to bring closure plate 35 again to underlying relationship to the lower end 31 of the duct, thereby permitting further ice bodies to be delivered into the duct from the storage chamber by the subsequent energization of the agitator motor 21 during the extended timed interval controlled by time delay 75.

A similar operation is effected relative to the right-hand duct which is controlled by a closure plate switch 77 associated with the right-hand closure plate and solenoid coils **60*b*, 61*b* and 62*b* associated with the control switches 67', 68' and 69', as shown in FIGS. 2 and 5. In the illustrated embodiment, the use of the tined elements 51, 52 and 53 for controlling the quantities of ice bodies delivered provides additionally the function of separating the ice bodies, to some degree, in the duct 27 for further facilitating the dispensing operation. Thus, the tined elements tend to separate rather than crush or break the ice bodies as they are moved into the duct in effecting the desired selective dispensing. Further, by sizing the opening 26** to be smaller in cross section than the duct, a relatively free transfer of the ice bodies in the duct is provided, again providing for facilitated dispensing.

Spring 59 effectively fully withdraws the tines 54 and 55 from the duct in the retracted disposition thereof so as to permit free downward movement of the ice bodies in refilling the duct and during the dispensing operation relative to those forked elements disposed below the selected inserted forked element.

The foregoing disclosure of specific embodiments is illustrative of the broad inventive concepts comprehended by the invention.

We claim:

1. An ice body dispenser comprising:

means defining a delivery duct for containing ice bodies and having a lower outlet for dispensing ice bodies therefrom;

separating means comprising at least one control element selectively insertable laterally into said duct to extend at least partially across the duct at any one of a plurality of vertically spaced preselected positions above said outlet;

closure means for selectively preventing delivery of ice bodies through said outlet;

operating means having a plurality of sensing devices responsive respectively to disposition of different size cups below said outlet to cause (a) insertion of said separating means into said duct at one of said preselected positions correlated with the size of a selected cup, and (b) disposition of said closure means suitable to permit delivery from said duct outlet into the selected cup the quantity of ice bodies previously retained in said duct about said closure means and below said one of the preselected positions correlated with the selected cup size; and supporting means for supporting any selected one of the different size cups in a single, common dispensing space subjacent said outlet to dispose a portion of the selected cup suitably to actuate only one of said operating means sensing devices and thereby cause delivery of said correlated quantity of ice bodies to the selected cup.

2. The ice body dispenser of claim 1 wherein said means for supporting the selected cup comprises a grid structure having means for horizontal and vertical positioning of a cup removably placed thereon.

3. The ice body dispenser of claim 1 wherein said supporting means is adapted to support selectively in said dispensing space cups having different heights to cause selctive operation of the operating means as a result of different positions of a top portion of the cups.

4. The ice body dispenser of claim 1 wherein said supporting means includes means for supporting selectively a large size cup and a small size cup at different elevations below said duct outlet in said dispensing space.

5. The ice body dispenser of claim 1 wherein said supporting means includes means for supporting selectively a large size cup and a small size cup at different elevations and an intermediate size cup at the same elevation as one of said large and small size cups below said duct outlet in said dispensing space.

6. The ice body dispenser of claim 1 wherein said supporting means includes means for supporting selectively a large size cup and a small size cup at different elevations and an intermediate size cup at the same elevation as said large size cup below said duct outlet in said dispensing space.

7. The ice body dispenser of claim 1 wherein said supporting means is adapted to support selectively in said dispensing space cups having different heights to cause selective operation of the operating means as a result of different positions of a top portion of the cups, said operating means defining a plurality of vertically aligned switches one each at a corresponding plurality of different elevations disposed to be engaged selectively by the corresponding ones of the different height cups, the uppermost sensing device being closest to said dispensing space and the lowermost sensing device being furthest from said dispensing space.

8. An ice body dispenser comprising:

means defining a delivery duct for containing ice bodies and having a lower outlet for dispensing ice bodies therefrom;

separating means comprising at least one control element selectively insertable laterally into said duct to extend at least partially across the duct at any one of a plurality of vertically spaced preselected positions above said outlet;

closure means for selectively preventing delivery of ice bodies through said outlet;

operating means having a plurality of electrical switches each having an associated actuator responsive respectively to disposition of different size cups below said outlet to cause (a) insertion of said separating means into said duct at one of the preselected positions correlated with the size of a selected cup, and (b) disposition of said closure means suitably to permit delivery from said duct outlet into the selected cup the quantity of ice bodies previously retained in said duct above said closure means and below said one of said preselected positions correlated with the selected cup size; and supporting means for supporting any selected one of the different size cups in a single, common dispensing space subjacent said outlet to dispose a portion of the selected cup suitably to actuate only one of said operating means switch actuators and thereby cause delivery of said correlated quantity of ice bodies to the selected cup.

9. The ice body dispenser of claim 8 wherein said switches are vertically aligned, the uppermost switch being disposed closer to the dispensing space than the lowermost switch.

10. The ice body dispenser of claim 8 wherein said switches are vertically aligned, the uppermost switch and actuator thereof being disposed closer to the dispensing space than the lowermost switch and actuator thereof.

11. The ice body dispenser of claim 8 wherein said switches are vertically aligned, the uppermost switch and actuator thereof being disposed closer to the dispensing space than the lowermost switch and actuator thereof, and said supporting means being arranged to support said different size cups in correspondingly different horizontally related positions.

12. An ice body dispenser comprising:

means defining a storage chamber for storing a plurality of ice bodies;

means defining a delivery duct having an upper portion opening into said storage chamber for receiving ice bodies therefrom, and a lower outlet for dispensing ice bodies therefrom;

a plurality of vertically spaced control elements selectively insertable laterally into said duct at a corresponding plurality of vertically spaced preselected positions intermediate said upper portion and outlet to prevent delivery of ice bodies downwardly from above an inserted one of said control elements;

a closure selectively closing said outlet for preventing delivery of ice bodies through said outlet;

operating means responsive to disposition of a selected one of a plurality of different size cups below said outlet to cause concurrently (a) an inserting of one of said control elements corresponding to the selected size cup into said duct and (b) withdrawal of said closure from said outlet to dispense from said duct outlet into the selected cup those ice bodies previously delivered to the duct from said storage chamber disposed above said outlet and below the inserted control element, and means for returning the closure to close said outlet and withdrawing the inserted control element after said ice bodies have been dispensed through said outlet; and delivery means for urging ice bodies from said storage chamber through said duct upper portion after the closure is returned and the inserted control element is withdrawn to refill the duct above the returned closure.

13. The ice body dispenser of claim 12 wherein said delivery means is actuated concurrently with the return of said closure to the outlet closing disposition.

14. The ice body dispenser of claim 12 wherein said delivery means includes means for agitating the ice bodies in said storage chamber and urging the agitated ice bodies into said upper portion of the duct as an incident of such agitation.

15. The ice body dispenser of claim 12 wherein said delivery means includes means for agitating the ice bodies in said storage chamber and urging the agitated ice bodies into said upper portion of the duct as an incident of such agitation and means for initiating operation of the agitating means concurrently with the return of said closure to the outlet closing disposition.

16. The ice body dispenser of claim 12 wherein said delivery means includes means for agitating the ice bodies in said storage chamber and urging the ice bodies into said upper portion of the duct as an incident of such agitation, said ice body dispenser including at least one additional such duct, plurality of control elements associated with said second duct, closure means, operating means, closure returning means, and delivery means, said agitating means urging ice bodies into each of said ducts concurrently to refill any unfilled duct.

17. The ice body dispenser of claim 12 wherein said delivery means includes means for agitating the ice bodies in said storage chamber and urging the ice bodies into said upper portion of the duct as an incident of such agitation, said ice body dispenser including at least one additional such duct, plurality of control elements associated with said second duct, closure means, operating means, closure returning means, and delivery means, said agitating means urging ice bodies into each of said ducts concurrently to refill any unfilled duct, said agitation causing the ice bodies in the storage chamber to be urged past the ice bodies in the upper portion of any filled duct while causing ice bodies to be urged into any unfilled duct during operation thereof.

18. An ice body dispenser comprising:

means defining a storage chamber for storing ice bodies;

a plurality of ice body delivery ducts, each duct opening to said storage chamber to receive and be filled with ice bodies therefrom;

means for selectively delivering ice bodies from the respective ducts; and urging means for urging ice bodies from the storage chamber into each duct concurrently as an incident of delivery of ice bodies from any one of said ducts, the ice bodies in any of the filled ducts blocking delivery of further ice bodies thereinto by said urging means whereby any duct from which ice bodies have been delivered is refilled by said urging means.

19. The ice body dispenser of claim 18 wherein said urging means is caused to be operated upon initiation of a delivery of ice bodies from any duct.

20. The ice body dispenser of claim 18 wherein said urging means is caused to be operated upon initiation of a delivery of ice bodies from any duct, each duct further including means for retaining ice bodies in the portion thereof communicating with the storage chamber during the delivery of ice bodies from the duct and causing movement of the ice bodies further into the duct away from said portion only upon completion of the delivery, whereby the duct is refilled from the storage chamber only upon such completion of the delivery of ice bodies from the duct.

21. The ice body dispenser of claim 18 wherein said urging means is caused to be operated upon initiation of a delivery of ice bodies from any duct, each duct further including means for retaining ice bodies in the portion thereof communicating with the storage chamber during the delivery of ice bodies from the duct and causing movement of the ice bodies further into the duct away from said portion only upon completion of the delivery, whereby the duct is refilled from the storage chamber only upon such completion of the delivery of ice bodies from the duct, and further including means for causing the quantity of ice bodies delivered from the ducts to be correlated with the size of a receptacle brought into position to receive the ice bodies from the respective ducts.

22. The ice body dispenser of claim 18 wherein said urging means is caused to be operated upon initiation of a delivery of ice bodies from any duct, each duct further including means for retaining ice bodies in the portion thereof communicating with the storage chamber during the delivery of ice bodies from the duct and causing movement of the ice bodies further into the duct away from said portion only upon completion of the delivery, whereby the duct is refilled from the storage chamber only upon such completion of the delivery of ice bodies from the duct, and further including means for causing the quantity of ice bodies delivered from the ducts to be correlated with the size of a receptacle brought into position to receive the ice bodies from the respective ducts, said urging means being caused to be operated as an incident of the placement of the receptacle in said positions.

* * * * *